United States Patent [19]

Kolton et al.

[11] Patent Number: 4,512,093

[45] Date of Patent: Apr. 23, 1985

[54] INTEGRAL TAG AND TIE

[75] Inventors: Chester Kolton, Westfield; Stuart S. Spater, Livingston, both of N.J.

[73] Assignee: B & G Plastics, Inc., New York, N.Y.

[21] Appl. No.: 540,481

[22] Filed: Oct. 11, 1983

[51] Int. Cl.[3] ..... G09F 3/08

[52] U.S. Cl. ..... 40/20 R; 40/2 R; 40/21 R

[58] Field of Search ..... 40/20, 21, 300, 2

[56] References Cited

U.S. PATENT DOCUMENTS

| | | | |
|---|---|---|---|
| 1,875,493 | 9/1932 | Puc | 40/21 R |
| 2,588,963 | 3/1952 | Moberg | 40/21 R |
| 3,187,450 | 1/1965 | Stoffel | 40/21 R |
| 3,561,074 | 2/1971 | Mosher et al. | 40/21 R |
| 3,785,337 | 1/1974 | Flowerday | 40/21 R |
| 3,961,431 | 6/1976 | Kalenian | 40/21 R |

*Primary Examiner*—Hugh R. Chamblee
*Assistant Examiner*—Wenceslao J. Contreras
*Attorney, Agent, or Firm*—Robin Blecker & Daley

[57] ABSTRACT

An article identification tag has a tag body portion and a tag tie extending integrally from the tag body part. The tag tie has, at its end, a latch projection for retention in a latch opening formed in the tag body part, adjacent an identifier expanse on the tag body part. Configuration of the tag interfitting components is such that essentially no grippable surface is presented in the vicinity of the latched components upon looping of the tie through an article and securement of the tag components.

5 Claims, 8 Drawing Figures

INTEGRAL TAG AND TIE

FIELD OF THE INVENTION

This invention relates to tags for article identification and like uses.

BACKGROUND OF THE INVENTION

In tagging various consumer articles, it is desirable to provide tamper-retardant tags, both from the viewpoint of insuring that the intended tag-indicated price is paid for the article rather than a lower price effected by tag switching and from the viewpoint of preserving proper source identification, particularly for goods involving a significant trademark in a highly competitive field of trademarked articles.

In known prior art article tagging practices, for example, in luggage tagging as shown in U.S. Pat. No. 3,530,543, a tag string is inserted through a separate identification tag and is then inserted through a handle of the luggage. One end of the string has a locking tab integral therewith and the other string end has a latching member insertable in the locking tab for securement.

In another practice, shown in U.S. Pat. Nos. 3,402,435 and 3,422,499, a tag string or tie is securable to an article within its length and has an end string extent securable to the again separate identification tag.

In the two approaches discussed, disadvantage is seen in several respects. The article tagging practice involves three elements and two manipulative steps. One need thus assemble the tag string with both the article and the identification tag. The tag string and identification tag are separately fabricated and require separate handling. Further, little or no tamper-retardance is afforded.

SUMMARY OF THE INVENTION

The present invention has as its primary object the provision of tags efficiently meeting both of the discussed tamper-retardant aspects.

As a more particular object, the invention looks to providing the trade with tamper-retardant tags of type themselves providing article identification and requiring only simple one-step application to an article.

In attaining these and other objects, tags in accordance with the invention have a tag body part with a trademark or logo thereon, a tag tie or filament extending integrally from the tag body part and of flexible nature for insertion through on article or part thereof. At its end distal from the tag body part, a tag of the invention includes a latch projection and the tag body part includes, proximate the filament extension therefrom, a latch opening. The latch projection and opening are compatible in configuration for tamper deterence such that, in their mutually latched condition, one finds only continuous bounding surface extent of the latch member accessible exteriorly of the tags. Since the tag tie and tag article identification body part are integral, one-step assembly with an article is enabled.

The foregoing and other objects and features of the invention will be further evident from the following detailed description of a preferred embodiment thereof and from the drawings wherein like reference numerals identify like parts throughout.

DESCRIPTION OF THE PREFERRED EMBODIMENT

Figure 1:
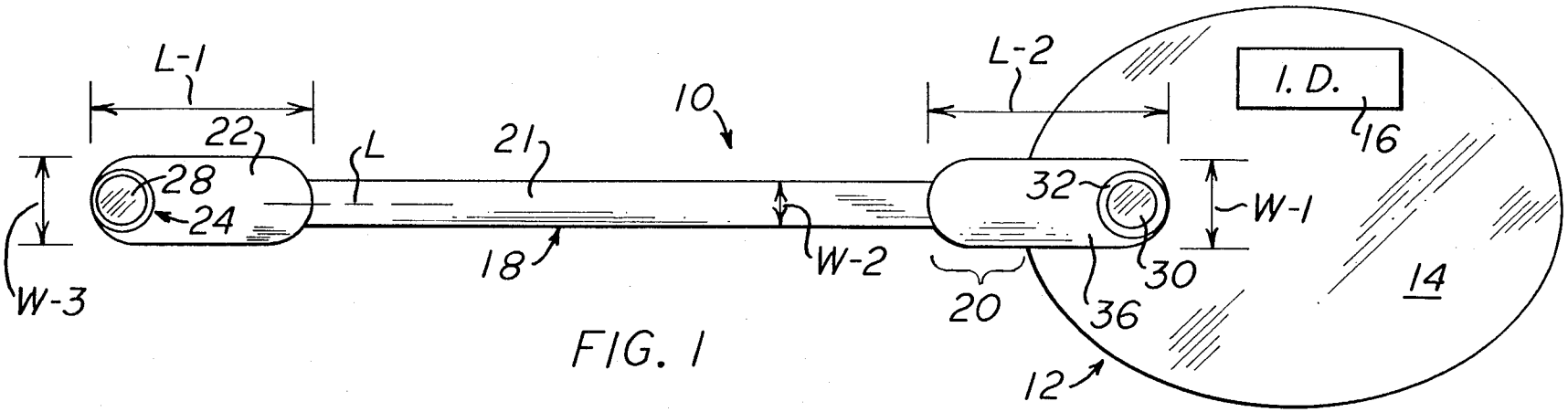
FIG. 1 is a top plan view of a tag in accordance with the invention.
Figure 2:
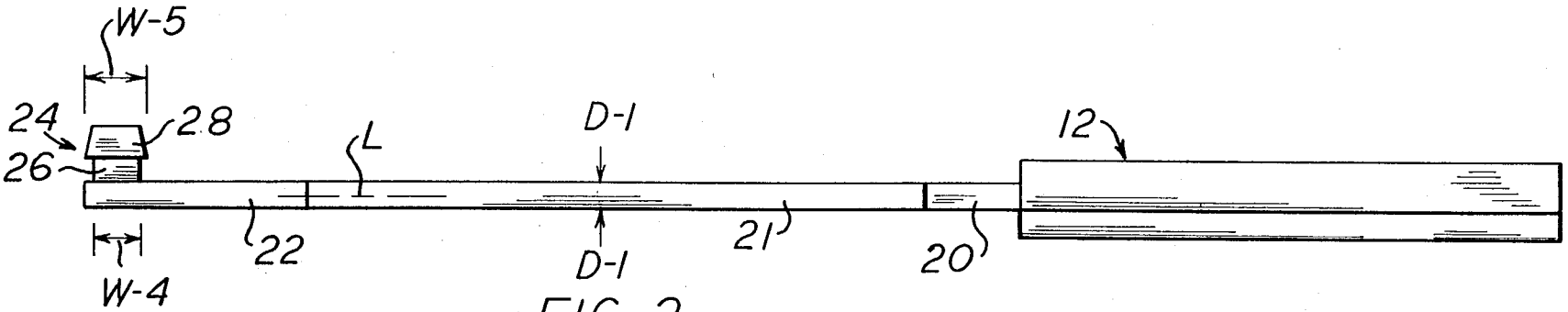
FIG. 2 is a front elevation of the FIG. 1 tag.
Figure 3:
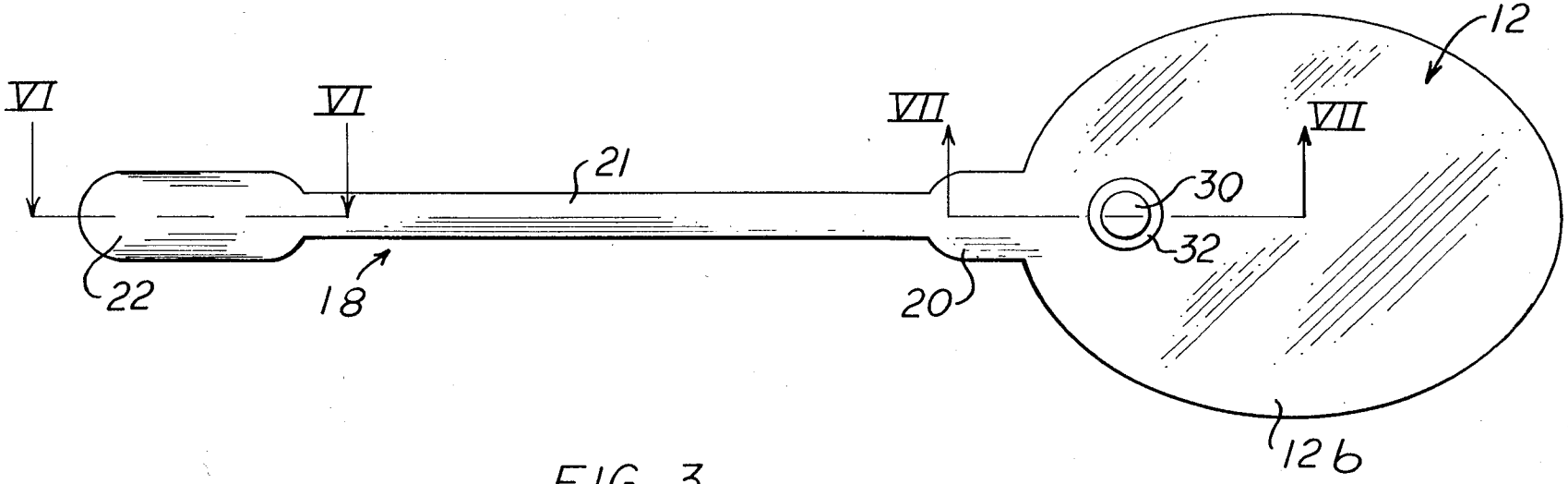
FIG. 3 is a bottom plan view of the FIG. 1 tag.

Referring to FIGS 1–3, article identification tag 10 is an integral body comprised of synthetic resinous material and includes a tag body part 12 having an identifier expanse 14 bearing indicia 16, typically a trademark or logo. Indicia 16 are preferably embossed or reverse-embossed on expanse 14, meaning respectively that the indicia extend above expanse 14 or are indented therein.

Tag tie or filament 18 is an elongate element having a first end portion 20 extending integrally from the left end of body part 12 and is of width W-1. An imtermediate portion 21, sufficiently flexible to be readily formed in a loop is of width W-2, less than W-1, and extends longitudinally from portion 20 to tie second end portion 22, which is of width W-3, equal to W-1.

Latch projection 24 extends from tie end portion 22 upwardly in FIG. 2 and normal to the longitudinal axis L of tie 18. Projection 24 includes an interior reduced diameter part 26 of width (diameter) W-4 and a frustroconical part 28 tapering from width (diameter) W-5 to width W-4 at its upper extremity.

Referring jointly to FIGS. 1 and 3, tag body part 12 includes an opening 30 extending between opposed surfaces of the tag body part. As is best seen in FIG. 7, opening 30 is of width W-5 and includes an interior ledge 32 having an opening 34 therethrough of width W-4, which is less than W-5 to effect latching of projection 24, as will be discussed below.

Figure 7:
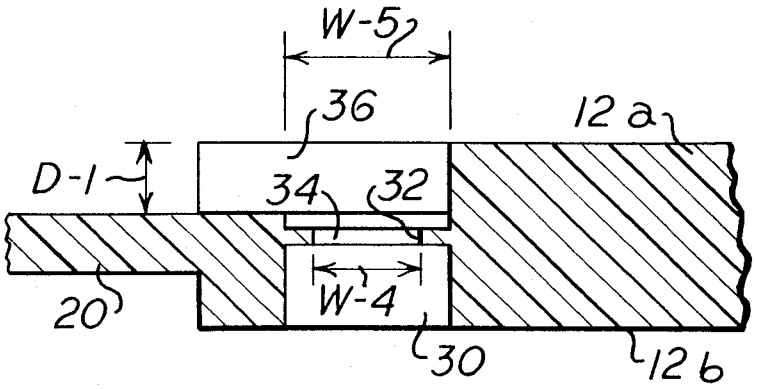
FIG. 7 is an enlarged partial sectional view of the tag as would be seen from plane VII—VII of FIG. 3.

Filament first end portion 20 is contiguous with a channel 36 formed in tag body part 12 and opening into its upper surface 12*a* (FIG. 7). The channel is of depth D-1, D-1 also being the depth of tie 18 (FIG. 2). Channel 36 extends into registry with opening 30 and, as is best seen in FIG. 1, channel 36 taken with first tie end portion 20 defines a common geometric configuration with tie second end portion 22, i.e., of length L-1 equal to L-2 and of width W-1 equal to W-3.

Figure 4:
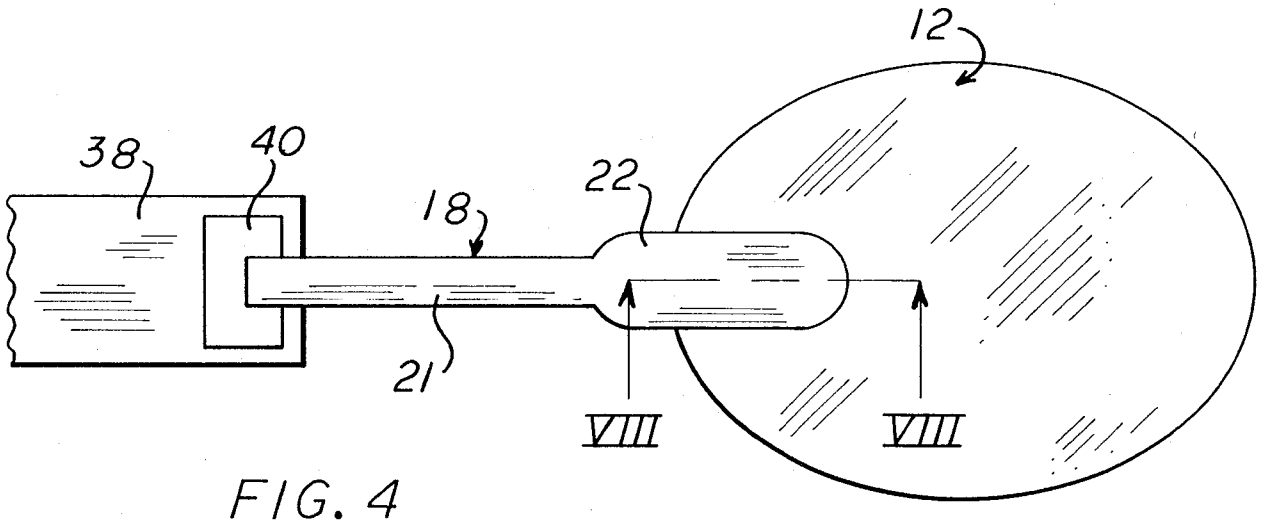
FIG. 4 is a top plan assembly view of the FIG. 1 tag and an article thereby identified.
Figure 5:
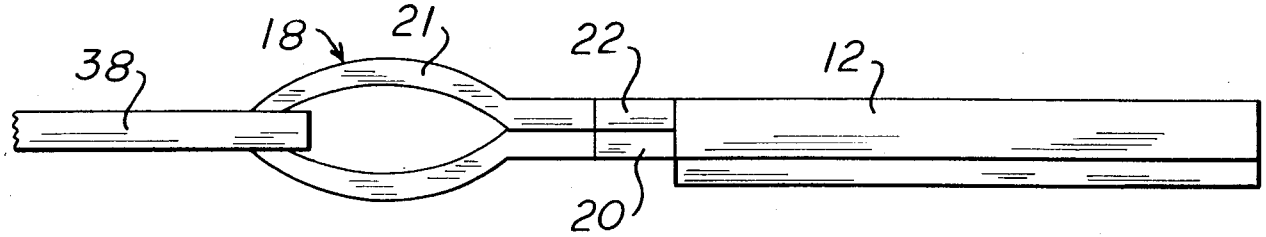
FIG. 5 is a front elevation of the FIG. 4 assembly.

Referring to FIGS. 4 and 5, the tag of FIGS. 1–3 is shown assembled with an article 38, shown as the tab of a zipper and having tag securement opening 40 therethrough. In assembly, tie second end portion 22 is inserted through opening 40 and tie 18 is then formed into a loop, with the tie end portion 22 then seated in channel 36 (FIG. 1) and latching projection 24 forcibly displaced into tag body part 12 to secure the same to article 38.

Figure 8:
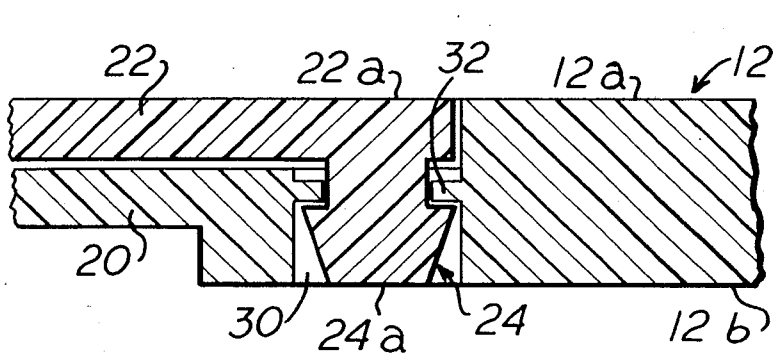
FIG. 8 is an enlarged partial sectional view of the assembled tag as would be seen from plane VIII—VIII of FIG. 4.
Figure 6:
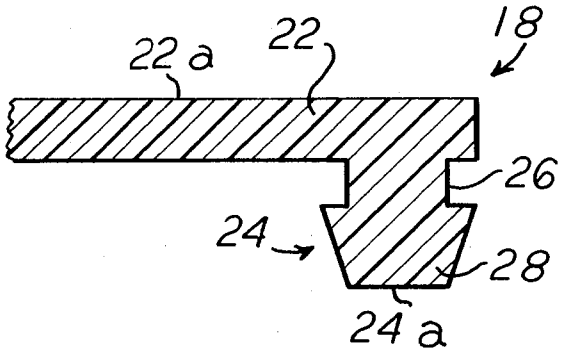
FIG. 6 is an enlarged partial sectional view of the tag as would be seen from plane VI—VI of FIG. 3.

The character of the securement of parts in the course of assembly is seen in FIGS. 6–8. FIG. 6 shows a sectional view of second end portion 22 of tie 18 and FIG. 7 shows a sectional view of the leftward end of tag body part 12 and tie first end portion 20. The sectioned parts of FIGS. 6 and 7 are shown assembled in FIG. 8. In the course of assembly, frustro-conical part 28 of latch projection 24 is forced into opening 30 and passes beyond ledge 32, the ledge resiliently yielding in the course of such passage and then returning to its FIG. 8 disposition, i.e. resident in bounding relation to reduced-diameter part 26 of latch projection 24 and in retentive relation to part 28. Projection 24 will be seen to be fully resident in tag body part 12 and tie second end portion 22 has its upper surface 22*a* substantially in a common plane with surface 12*a* of tie body part 12, or slightly recessed below surface 12*a*, and resident in channel 36. Tie second end portion 22 extends contiguously parallel with tie first-end portion 20.

Several advantageous features attend the structure described. As noted above, the latch projection is fully resident in the tag body part. Grippable surfaces of the latch projection are thus not available for tampering purposes. Only substantially planar surface 24*a* of the latch projection is accessible. Further, based on the nesting of the major extent of tie second end portion 22 in channel 36, only its top substantially planar surface 22*a* is accessible in the vicinity of the location of the latched components and not the depending side surfaces of this extent of the tie second end portion, since these surfaces are resident in the channel. Additionally, tie end portion 22 is restrained against movement transversely (in the plane of FIG. 1) to the longitudinal axis L of tie 18 by the sidewalls of channel 36.

Various changes and modifications may be introduced in the foregoing preferred embodiment without departing from the invention. For example, bottom surface 12*b* (FIG. 8) can be arranged in closing relation to opening 30, i.e., be continuous across opening 30, by vertically extending tag body part 12 downwardly beyond opening 30. Accordingly, the particularly disclosed and described embodiment is intended in an illustrative and not in a limiting sense. The true spirit and scope of the invention is set forth in the following claims.

We claim:

1. A tag comprising a unitary body having a tag body part and a flexible elongate tag tie having a first end extending from one end of said tag body part, said tag tie defining a latch projection extending normal thereto at a second end of said tag tie distal from said first end thereof, said tag body part having a latch opening adjacent said one end thereof and extending normal to said tag tie and of dimensions adapted to receive said latch projection, said tag body part further defining a channel, opening into exterior surface of said tag body part, and extending longitudinally with said tag tie from said one end of said tag body part commencing at said tag tie first end into registry with said opening, said channel being configured in complementary manner with a portion of said tag tie adjacent said latch projection, whereby said tag tie portion is adapted for nesting residence in said channel upon insertion of said projection into said latch opening.

2. The invention claimed in claim 1 wherein said channel opens into a surface of said tag body part along the length of said channel and has such depth in said tag body part that a surface of said tag tie extent is substantially in a common plane with said tag body part surface upon residence of said latch projection in said tag body part.

3. The invention claimed in claim 1 wherein said tag body part includes a surface expanse adjacent said opening substantially exceeding said opening in surface area and supporting indicia for identification of an article.

4. The invention claimed in claim 3 wherein said indicia are formed integrally with said tag body part.

5. An assembled article and identification tag therefor, comprising an article having a tag securement opening therethrough and a tag tie having an intermediate extent in said article opening and first and second end portions at respective opposed ends of said tie intermediate extent, and a tag body part integral with said tag tie and bearing article identifying indicia, said tie first end portion extending from said tag body part, said tie second end portion extending contiguously parallel with said tie first end portion and being secured to said tag body part, said tie second end portion including a latch projection, said tag body part defining a latch opening retaining said latch projection, said latch projection being resident in said tag body part, said tag body part also defining a channel, opening into exterior surface thereof for receiving said tie second end portion, said channel extending into registry with said latch opening, said channel so seating said tie second end portion that extent thereof in registry with said latch projection is nested in said tag body part.

* * * * *